US005456655A

United States Patent [19]

Morris

[11] Patent Number: 5,456,655

[45] Date of Patent: Oct. 10, 1995

[54] AMBULATORY SUPPORT SYSTEM FOR PATIENTS

[76] Inventor: C. Van Morris, 297 Boulevard, Athens, Ga. 30601

[21] Appl. No.: 99,916

[22] Filed: Jul. 30, 1993

[51] Int. Cl.[6] ..... A61H 1/02

[52] U.S. Cl. ..... 601/23; 5/81.1; 5/86.1; 128/846; 212/316

[58] Field of Search ..... 212/210, 205, 212/206; 5/81.1, 83.1, 84.1, 85.1, 86.1, 87.1, 88.1, 89.1; 601/23; 128/846

[56] References Cited

U.S. PATENT DOCUMENTS

| | | | |
|---|---|---|---|
| 669,217 | 3/1901 | Hanson | 5/83.1 |
| 1,385,424 | 7/1921 | Billings | 5/81.1 |
| 3,606,045 | 9/1971 | Abromavage . | |
| 4,003,479 | 1/1977 | Reyer | 5/86.1 |
| 4,125,903 | 11/1978 | Vail . | |
| 4,199,829 | 4/1980 | Watanabe | 5/81.1 |
| 4,243,147 | 1/1981 | Twitchell . | |
| 4,256,098 | 3/1981 | Swan | 5/81.1 |
| 4,445,502 | 5/1984 | Swan | 601/23 |
| 4,795,122 | 1/1989 | Petre . | |
| 4,973,044 | 11/1990 | Jones | 272/70.3 |
| 5,072,840 | 12/1991 | Asakawa . | |
| 5,273,502 | 12/1993 | Kelsey | 601/23 |

FOREIGN PATENT DOCUMENTS

| | | | |
|---|---|---|---|
| 304538 | 3/1989 | European Pat. Off. | 5/87.1 |

OTHER PUBLICATIONS

"New Falls Intervention Strategies and Rehabilitative Systems", by Triangle Research and Development Corporation (TRDC), North Carolina, Oct. 1991.

*Primary Examiner*—Robert A. Hafer
*Assistant Examiner*—David J. Kenealy
*Attorney, Agent, or Firm*—Jones & Askew

[57] ABSTRACT

An ambulatory support system for providing support for a patient. The support system includes an overhead system which allows a support carrier to travel within its confines so that it may be located above a patient at any time. The support system supplies a passive fall interruption device which restrain freefalling of a patient. The restraint system allows a patient, once falling, to be lowered slowly to the ground. In addition, the overhead support system of the present invention provides an accessory mount in which folding tables, IVs, monitors, and the like may be suspended from the ceiling and may be moved anywhere in the region underneath the overhead system.

21 Claims, 8 Drawing Sheets

AMBULATORY SUPPORT SYSTEM FOR PATIENTS

TECHNICAL FIELD OF THE INVENTION

The present invention is directed to a system of ambulatory support for a patient. The invention also provides overhead support for peripheral equipment found in a hospital room.

BACKGROUND OF THE INVENTION

Several factors suggest a growing demand for health care in the foreseeable future. The greatest factor is the aging of the population. The population of the United States has aged dramatically since the beginning of this century. In 1900, only 4% of the population were 65 years or older. This number had increased to 13% of the population (or 30 million people) by 1986 and is projected to grow to 21% in 2020 and 30% in 2050 (*Aging America,* 1987–88).

The healthcare system will have to respond to the aging of the population. As people age they make greater use of health services than do younger persons. According to the National Health Interview Study, in 1987 the rate of discharges from short-stay hospitals was 69.2 per 1,000 population for persons 15–44 years of age, 143.3 for those 45–64, and 255.8 per 1,000 for those 65 years of age and older. If current usage rates by the elderly were to continue, there would be twice as many physician visits and hospital stays in the year 2020 than at present and almost three times as many elderly residents in nursing homes than the current 1.3 million (*DHHS,* 1987). The elderly have health care needs ranging from preventative services to long-term care. Of special interest is the fact that advancing age brings about a decline in mobility, with significant limitations evident in the eighties and nineties. In addition to physical limitations, a significant proportion of the elderly have mental health problems, such as Alzheimer's disease and multi-infarct dementia.

Another factor that will increase demand for medical care is the AIDS epidemic. Until an effective treatment for the underlying pathological processes of this disorder is found, the symptomatic treatment of sufferers of this disease will demand the most sophisticated medical supportive care available. This is primarily because the disease can affect multiple order systems and because intermittent, technologically-sophisticated treatment can take a patient from near death back to productive life.

The hospitalized patient of today generally requires a higher intensity of care than that rendered 20 years ago. Many root causes underlie this trend. Technical, diagnostic, and treatment techniques have improved to the point that many diseases and procedures that once could only be handled in hospitals in the past are now handled in some form of outpatient procedure. Insurance carriers often demand that certain procedures be done on an outpatient basis, thereby saving the expense of a hospital stay. Patients have never wanted to be hospitalized if good outcomes are possible with outpatient procedures and medical treatment. The advent of all the technological advances in hospital care has added an enormous amount of equipment to each room. The hospitalized patient of today almost invariably requires specialized monitoring (cardiac, neurologic, or pulmonary), intravenous therapy, and physical assistance of some sort. Monitoring requires attachment of patient sensors which are connected by wires to a portable transmitter or directly to a monitoring device.

Because of the additional equipment which has been added to each room, current hospital environments offer too much clutter and unavailable floor space and therefore increase risk in the patient's immediate environment. Cluttered hospital rooms combined with sick or weak patients lead to a large number of falls in hospitals across the nation each year. The direct cost of falls in hospitals today averages about $1,500.00 per bed per year or $150,000.00 per 100 beds each year. The United States average for fall incidents is 1.7 falls per hospital bed per year. Five percent of these falls result in some form of serious injury, such as a hip fracture. The cost of these injuries average between $10,000.00 and $25,000.00. Each of these figures does not include the cost of liability claims, extended rehabilitation, long-term care, lost time for professional staff, or loss of goodwill. With the increase of older patients and nursing staff reductions, the number of falls will only increase.

The design of existing hospital rooms does not contribute to fall prevention. Generally, a patient utility table is in each patient room and the table serves as a surface upon which the patient may place his meal tray, carry on correspondence, work with crafts, or perform grooming tasks. The table is generally cantilevered from a side support member which is in turn supported by a four-wheeled floor base. This arrangement has been necessary because of the need to place the work surface of the table directly over the bed. The physics of the arrangement requires the dimensions of the wheeled floor base to be virtually the same as the dimensions of the table surface. The height of the table surface is adjustable so as to allow the table to be adaptable to various patient sizes, bed heights, and chair use. The main difficulty with the current patient utility tables has to do with the large supporting wheel base. These bases are very difficult to maneuver amongst the other objects resting upon the floor, such as bed side chests, bed supports, chair legs, and IV stands. Since these utility tables are not used most of the time, they contribute to floor clutter and become impediments to safe ambulation.

Intravenous (IV) therapy is now occurring in almost 85% of hospitalized patients. This therapy requires the use of IV stands. Provision is made for the use of an IV support pole on all modem hospital beds, and some rooms are equipped with IV supports hung from the wall or ceiling. The IV supports that are attached by a single point to the bed, wall, or ceiling severely limit patient mobility and are generally not used by either patient or staff. Some ceiling-supported IV systems traverse a small distance in a simple linear fashion but do not provide much patient mobility. To address the lack of mobility inherent in other forms of currently used IV stands, a steady trend in IV therapy has been the use of a wheeled IV stand. The wheeled IV stand has many of the same problems as the wheeled utility table, such as difficult maneuvering within small spaces, difficulty of storage, and interference with patient ambulation due to the contribution to floor clutter.

Telemetry transmitters and monitoring equipment such as EKG telemetry, apnea monitors, and oximetry telemetry require the attachment of patient sensors which are connected by wires to a portable transmitter or directly to a monitoring device. Currently the patient must wrestle with these transmitters as he or she tries to rest or sleep. When walking, the patient has to be concerned with transporting the monitor or transmitter along his or her side.

An integrated, expandable system which organizes, stores, and improves the function of these different devices is definitely needed. Preferably, such a system would remove each of these devices from floor spaces in the room and allow immediate accessibility to the devices at all points in the room.

Many patients with neuromuscular diseases and degenerative central nervous system disorders suffer from decreased bed mobility. They find it difficult to turn themselves in bed, or come to the sitting or standing position from the lying one. Currently, one of the main approaches to facilitation of independent bed mobility is the use of the orthopedic frame equipped with a trapeze. Problems with this device are that it requires installation of the frame upon the bed by an orthopedic technician and it cannot be used anywhere except over a patient's bed. The trapeze is not available for the patient to use to rise from a chair or a portable commode. There is a need to make the trapeze both accessible to all pans of the room, as well as easy to install.

Patients who have impaired ambulation or central nervous diseases which cause difficulties with imbalance now often employ walkers while in their hospital environment. These walkers function fairly well in the home environment, but in the cluttered, cramped hospital environment, they are often not maneuverable enough to offer effective assistance to the gait impaired. There is a need for a different means of offering support for the gait impaired.

In physical therapy departments, an area is generally set apart for gait training. Currently, this part of physical therapy is very labor-intensive because of the need to have ample personnel present to prevent falls. Rehabilitation of the individual with gait disability (orthopedic or neurologic) who also has significant upper extremity weakness or injury is almost impossible due to the fact that all currently used gait assistance devices require some upper extremity function and strength. For example, a person unable to support himself with his arms is generally not able to walk with the aid of a walker or some form of arm rail. There is a need for a new form of gait assistance which is both reliable and independent of help of others. The device would preferably not rely on floor support for its use.

In the current hospital environment, multiple strategies have been employed to reduce falls. Currently, most hospitals use some form of fall prevention program. The hospitals try to identify patients who have profiles that are known to carry higher risks for suffering falls and institute an appropriate individualized response in the at-risk patient. In some cases, it is as simple as asking the patient not to get out of bed unless assistance is called. This strategy works rather well for the passive, compliant patient, but it fails miserably in the impatient individual or in the confused or forgetful individual. If trouble with compliance with the up-only-with-assistance order is anticipated, other measures may be employed. The simplest and most acceptable measure would be for the patient to be in constant attendance by either a sitter or a family member. However, sitters are quite expensive and an adequate number of family members is generally hard to find. In addition, human observation fails because humans are not constantly vigilant and tend to become least attentive to the patient fall problem when the problem is most likely to occur—in the middle of the night. Moreover, even the weakest patient can move very quickly at times and falls occur despite the presence of a vigilant observer. Even if the patient's fall is prevented by the observer, there is some risk of injury to the attendant as he or she physically breaks the fall.

High-tech monitoring devices that tell the nursing staff when the patient is up and on the move have also been employed to prevent falling. However, the monitoring devices such as Ambulert® or types of video monitoring devices are exactly what they are named, simply monitoring devices. The devices do not prevent an occurrence, but instead only allow the remote sensing or observation of an activity. Successful fall prevention depends upon timely response by monitoring personnel and sometimes even the fastest response is not fast enough. Thus, this method of fall prevention is not functioning in a real time fashion. Video monitoring also involves a certain amount of loss of privacy that some individuals find unacceptable.

Various bed rail configurations have also been designed to confine a patient to the bed. The bed rails are user-friendly only to the care givers, and the patient is forced to defeat them in ways that often make the bed rails a threat instead of a help to a patient's safety. Patients climb around, through, and most dangerously, over bed rails to freedom. Short falls turn into dives and the corresponding injuries are more severe. The Posey vest has been implemented to tie a patient to a bed or a chair. Although this vest prevents the falls, it works by extracting a tremendous price in loss of patient mobility and dignity. The loss in patient mobility causes corresponding patient morbidity. Because of decreased patient turning and repositioning, there is increased likelihood of skin breakdown due to decreased patient hygiene and pressure damage. Pulmonary toilet is diminished with diminished mobility. Finally and most tragically, the Posey vest is often misconstrued to be a form of incarceration by the individual who is being confined. The misinterpretation as to the motivation for the employment of this safety device often converts a pleasantly confused individual into a belligerent, agitated, and paranoid one. There is a need for a method of supporting a patient so that he or she may be protected if falling out of bed while asleep.

Other patient support apparati such as patient lifts or bed scales are much less frequently employed but suffer from the same difficulties of other floor mounted devices. For example, the devices in the patents to Asakawa (U.S. Pat. No. 5,072,840) and Vail (U.S. Pat. No. 4,125,908) disclose patient lifting systems. The device in the patent to Twitchell et al. (U.S. Pat. No. 4,243,147) is also a patient lift device but also includes three-dimensional movement while in the device. The device is intended for moving individuals who are severely afflicted or at least greatly impaired in mobility and require complete lifting. In that manner, the device serves much the same function as a wheelchair, but removes the movable support from the base floor system. The device does not provide enhanced mobility and support for patients who regularly are mobile. There is a need for such a device to prevent falls and to increase ambulation in already-mobile patients.

In summary, there is a need for organization in hospital rooms such that unneeded clutter may be removed from floors. This organization should offer safety for the patient and easy accessibility for hospital staff. In addition, there is a need for an ambulatory support system for a patient which can offer passive restraint. This support system preferably could also support the patient while moving about a room or while sleeping.

SUMMARY OF THE INVENTION

The present invention solves the above problems by providing a patient support system which is designed for enhanced mobility and support and intended for patients who are regularly mobile. The device offers an overhead design which benefits mobility and decreases clutter and therefore reduces falling. The device helps patients with good minds but weakened bodies to raise themselves without a prolonged wait for a nurse. Many patients with diminished judgment and/or defective ambulation can move from a bed to a chair unassisted, but should a slip occur they would be protected from a severe fall by the passive nature of the support system of this invention.

This invention also provides for attachment of IVs and other monitors attachment to the ceiling instead of the bed or floor. This attachment is such that equipment may follow the patient as he moves about the room. Thus, patient mobility is not impaired by attachment of the patient to these devices.

More specifically described, the present invention provides a device for giving ambulatory support to a patient. The device includes a support garment for associating with a patient, and a tether line extending from the support garment to a support carrier. An overhead support system supports the support carrier and allows movement of the support carrier within a specified region. A retraction system within the support carrier applies a first upward force to the tether line responsive to a force applied vertically downward by the patient. The first force varies in relation to the downward force applied by the patient and the acceleration of the tether line downward responsive to the downward force such that the first force remains slightly less than the downward force and prevents the acceleration of the tether line downward from reaching a predetermined speed. In this manner, the retraction system works to decelerate a patient upon falling so that the patient is slowly lowered to the ground.

The device may be also operative to provide a second force upward on the tether line which keeps the tether line taut such that when a patient is in the support garment, the tether line remains extended from the support garment to the overhead system in a substantially vertical orientation. This second force is inadequate to fully support the patient. A third force may also be provided which may be applied upward on the tether line. This force is greater than and overcomes the downward force applied by the patient such that the retraction system is operative to lift the patient.

The overhead support system of the present invention preferably includes a heavy glide rail arranged to span between opposite sides of the room and channel means secured in the room for supporting the ends of the glide rail so that the heavy glide rail can move therealong. The support carrier is arranged to travel back and forth on the heavy glide rail. In this manner, the support carrier may be positioned above any point in the room.

The device may also include an accessory dolly mounted for travel along the heavy glide rail, the accessory dolly configured so as to receive a peripheral accessory. In the same manner that the support carrier may be moved about the room, the peripheral accessory may be moved within an area underneath the overhead support system. The peripheral accessories may be any devices but could be specifically an IV pump, a fold-up table, a trapeze, an orthopedic traction set up, a walker, or a fold-up chair. The peripheral accessories could also be located in a second traveling bridge which also spans across the channels.

Therefore, it is an object of the present invention to provide an overhead support system for a patient.

It is a further object of the present invention to provide a support system which may lend support to an already-mobile patient.

A further object of the present invention is to provide organization in hospital rooms such that unneeded clutter may be removed from the floors.

Another object of the present invention is to provide an overhead support system for supporting patient monitoring equipment.

Yet another object of the present invention is to provide a method of supporting a patient so that he or she may sleep and be supported if he or she falls out of a bed.

Still another object of the present invention is to provide a form of gait assistance which is both reliable and independent of help from others.

It is a further object of the present invention to provide an overhead support system for supporting peripheral accessories in a hospital room accessible to any point within the room.

Other objects, features, and advantages will become apparent upon consideration of the following detailed description of the invention when taken in conjunction with the drawing and the appended claims.

DETAILED DESCRIPTION OF THE PREFERRED EMBODIMENT

Figure 1:
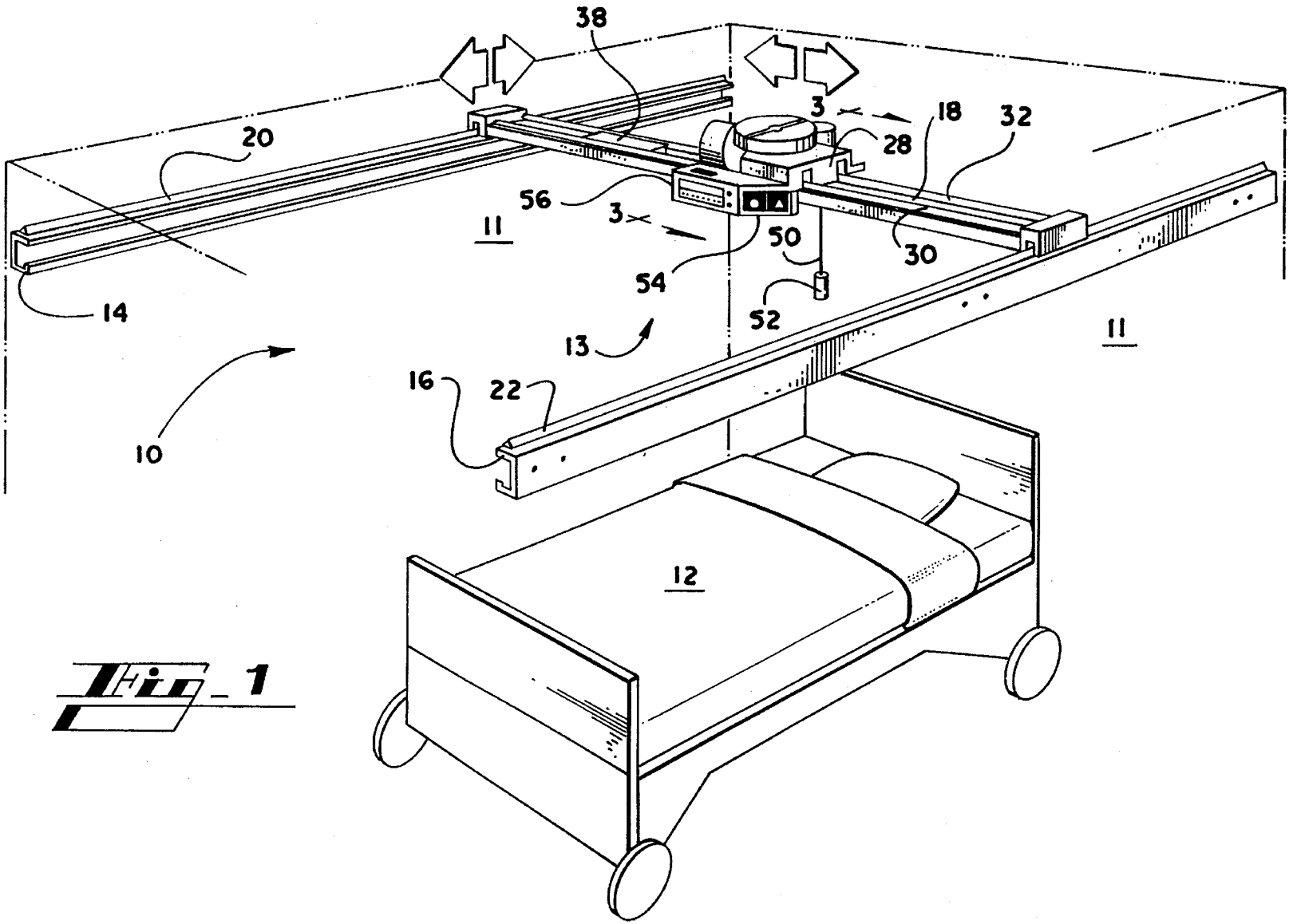
FIG. 1 is a perspective view taken within a room showing the ambulatory support system for a patient, according to a preferred embodiment of the present invention.

Referring now to the drawing, in which like reference numerals represent like parts throughout the several views, FIG. 1 shows a device 10 embodying the ambulatory support system of the present invention. The device is shown installed in a room within walls 11 over a bed 12. The device includes an overhead system 13 consisting of side support rails 14 and 16 and a heavy glide rail 18. The side support rails 14 and 16 are wall mounted approximate to the ceiling and the heavy glide rail 18 transverses and is supported by these rails.

Figure 2:
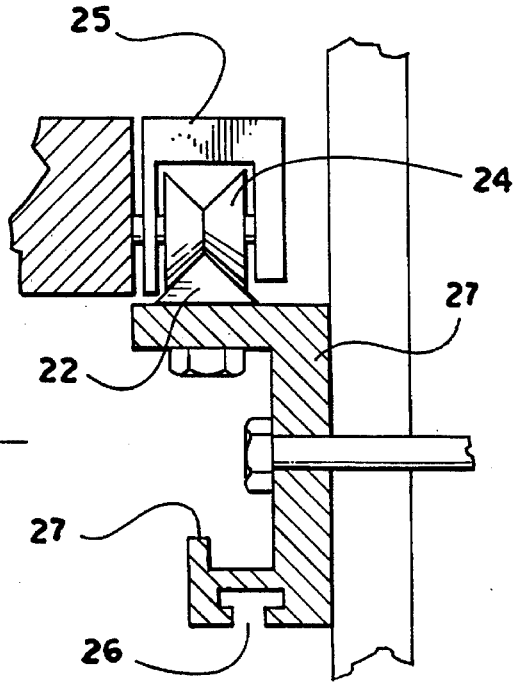
FIG. 2 is a cross section of the side support rail and the end of the heavy glide rail of FIG. 1 taken along the section lines 2—2 of FIG. 1.

FIG. 2 discloses the association between the heavy glide rail 18 and the side support rails 14 and 16. Steel runners 20 and 22 extend along the length of the side support rails 14 and 16. Rollers 24 in end caps 25 on the heavy glide rail 18 engage the runners 20 and 22 on the side rails 14 and 16 such that the heavy glide rail 18 may move freely along the length of the runners 20 and 22. An accessory mount 26 and an upturned flange 27 are located at the bottom of the side support rails 14 and 16, the use of which will be described in detail below.

A support carrier 28 is mounted for movement back and forth along the heavy glide rail 18. The heavy guide rail 18 includes two laterally spaced-apart runners 30 and 32 which extend along its length on the upper side of the heavy glide rail. As is shown by the cross-sectional view in FIG. 3, rollers 34 and 36 within the support carrier 28 engage the runners 30 and 32 so that the support carrier may move smoothly along the heavy glide rail 18. To give the heavy glide rail 18 a smoother feel, a counterweight 38 may be slidably contained in a longitudinal channel of the heavy glide rail and attached by cable and rollers (not shown) to the support carrier 28. This counterweight moves responsive to movement of the support carrier 28 and in the opposite direction to movement of the support carrier, and maintains a distance from the side support rail 14 or 16 which is further away from the support carrier, which is equal to the distance from the support carrier to the other side support rail 14 or 16. One or more accessory dollies 40 may be mounted for movement along the underside of the heavy glide rail 18. These accessory doilies 40 have wheels 41 and 42 which engage tracks within lips on the bottom side of the heavy glide rail 18 so that the accessory doily may easily move along the length of the heavy glide rail 18. The accessory dolly 40 includes an accessory mount 42, the use of which will be described in detail later. A tether line 50 extends from one side of the support carrier 28 and includes a quick disconnect 52 at its end. The support carrier 28 supports a patient by use of this tether line 50, as is explained in detail below. The support carrier 28 also includes a condition monitor display 54 and adjustment controls 56.

As shown in FIG. 1, the support carrier 28 may be positioned above any location in the room depicted in the drawing. This is possible because the heavy glide rail allows a complete range of movement in the dimension parallel to the side support rails 14 and 16, and the slidable attachment of the support carrier 28 to the heavy glide rail 18 provides movement in the dimension perpendicular to the side support rails 14 and 16.

Figure 4:
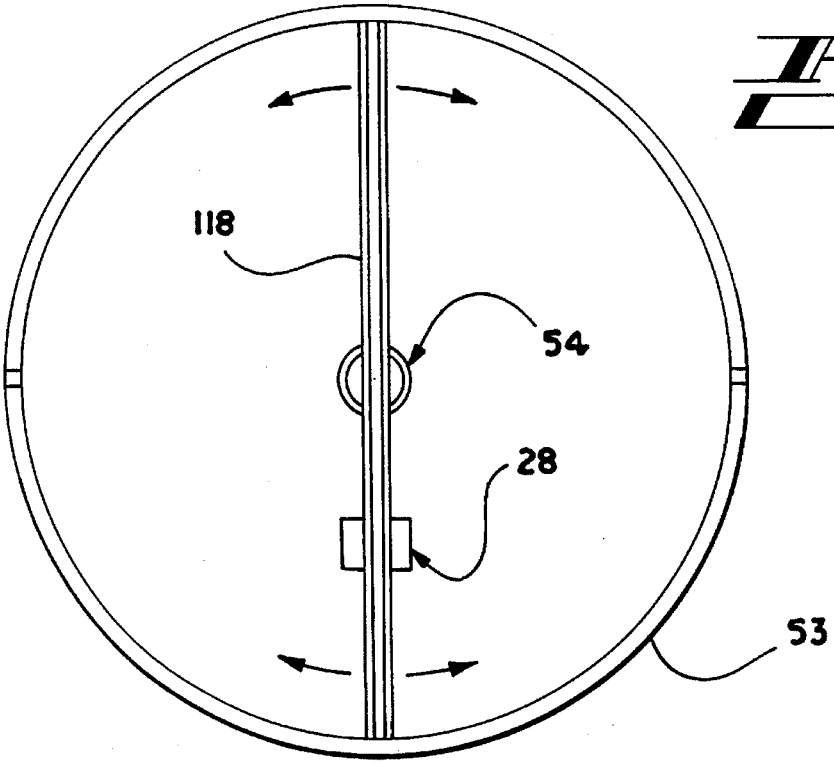
FIG. 4 is a bottom view of an alterative embodiment of the overhead system of the present invention.

An alternative embodiment of the overhead support system shown in FIG. 1 may include a circular side support system 53 with a transversely mounted heavy glide rail 118, as is shown in FIG. 4. The rotating heavy glide rail 118 is mounted across the diameter of the circular track 53 for sliding engagement with a runner (not shown) which is located along the top of the circular track. The support carrier 28 is slidingly mounted on the heavy glide rail 118. This system, like the other system, allows the support carrier 28 to be positioned directly above any point within the confines of the fixed track arrangement. The support carrier 28 may slide radially on the rotating track to a needed position, and the rotating heavy glide rail 118 may rotate to a needed orientation. If needed, a rotating central support 54 may be used to support the center of the heavy glide rail 118.

Figure 3:
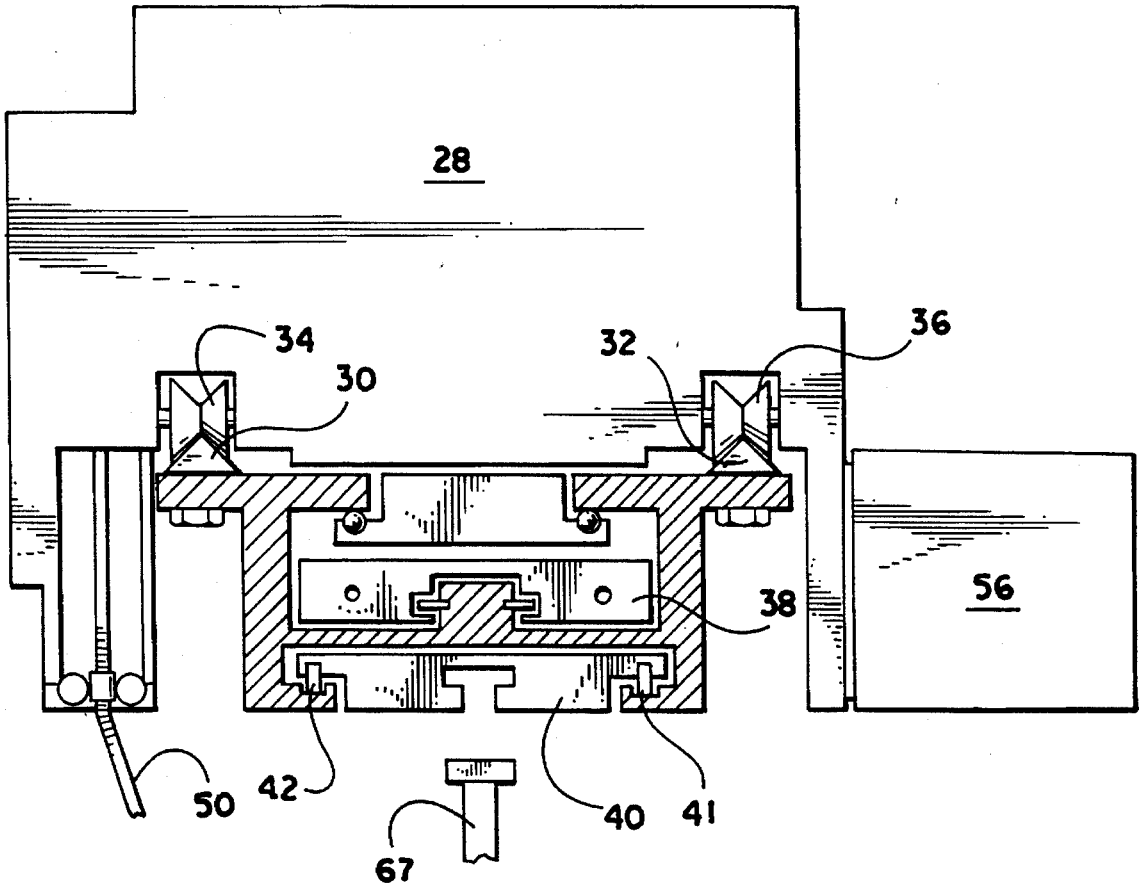
FIG. 3 is a cross section of the support carrier and heavy glide rail as shown in FIG. 1 taken along the section lines 3—3 of FIG. 1.
Figure 5:
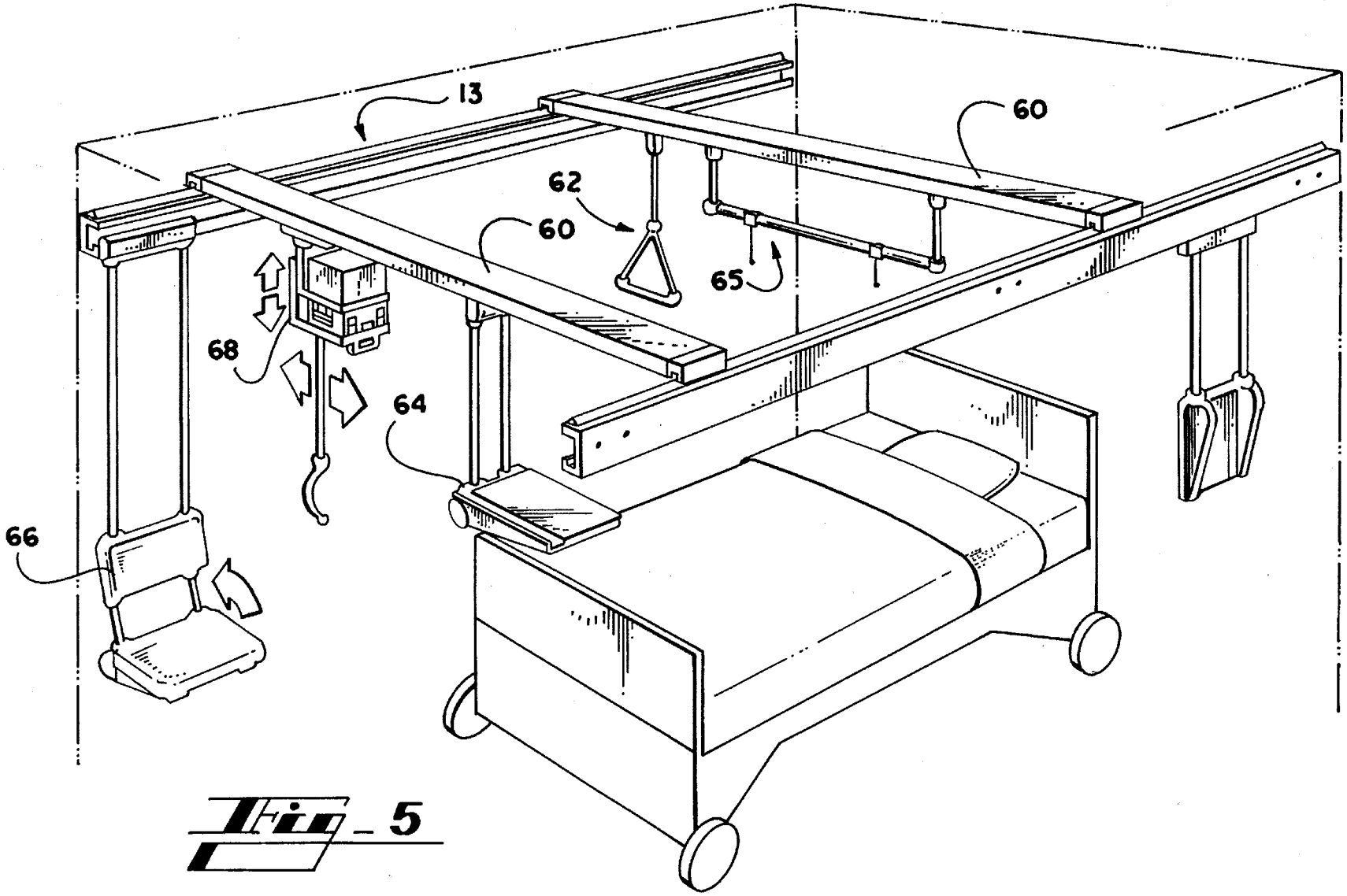
FIG. 5 is a perspective view of an alternative embodiment of the present invention showing different accessories which may be added to the overhead support system of FIG. 1.

In addition to the system of patient support supplied by the support carrier 28, the overhead support system 13 of the present invention may suspend any number of patient care devices. Several such devices are depicted in FIG. 5. Additional transverse tracks which serve as light accessory rails 60 may be mounted within the system so as to suspend various equipment from the overhead support system 13. For example, a trapeze 62 may be suspended above a bed from one of the light accessory rails 60. Also, a fold-up table 64 may be suspended from the rails 60 so that it may be easily used and then easily stored out of the way at a later time. The convenient mounting of the fold-up table 64 allows its height to be adjusted to fit a patient. An orthopedic traction set-up 65 or a walker (not shown) may also be provided. Likewise, a fold-up chair 66 may be employed in the overhead support system. The fold-up chair 66 shown in FIG. 5 is mounted on the upturned lip 27 of the side support rail 14. Preferably, however, the accessories are mounted to the accessory dollies 40 (as shown in FIG. 3 and as is described in detail above), so that they may have free movement in two dimensions about the room. The accessory dollies 40, therefore, have ends 67 (as shown in FIG. 3) which upon a one-quarter turn engage the accessory mounts 42 in the accessory dollies. At other times, when the accessories are not being used, they may be stored in the bottom of the side rail in the accessory mounts 26.

Another accessory which may be mounted in the overhead support system 13 of the present invention is an IV fluid reservoir/pump 68. This pump 68 may be mounted such that it may move up and down its support, so that it may be raised up near the ceiling to be stored in an unobtrusive fashion and may be lowered to set or refill.

Figure 8:
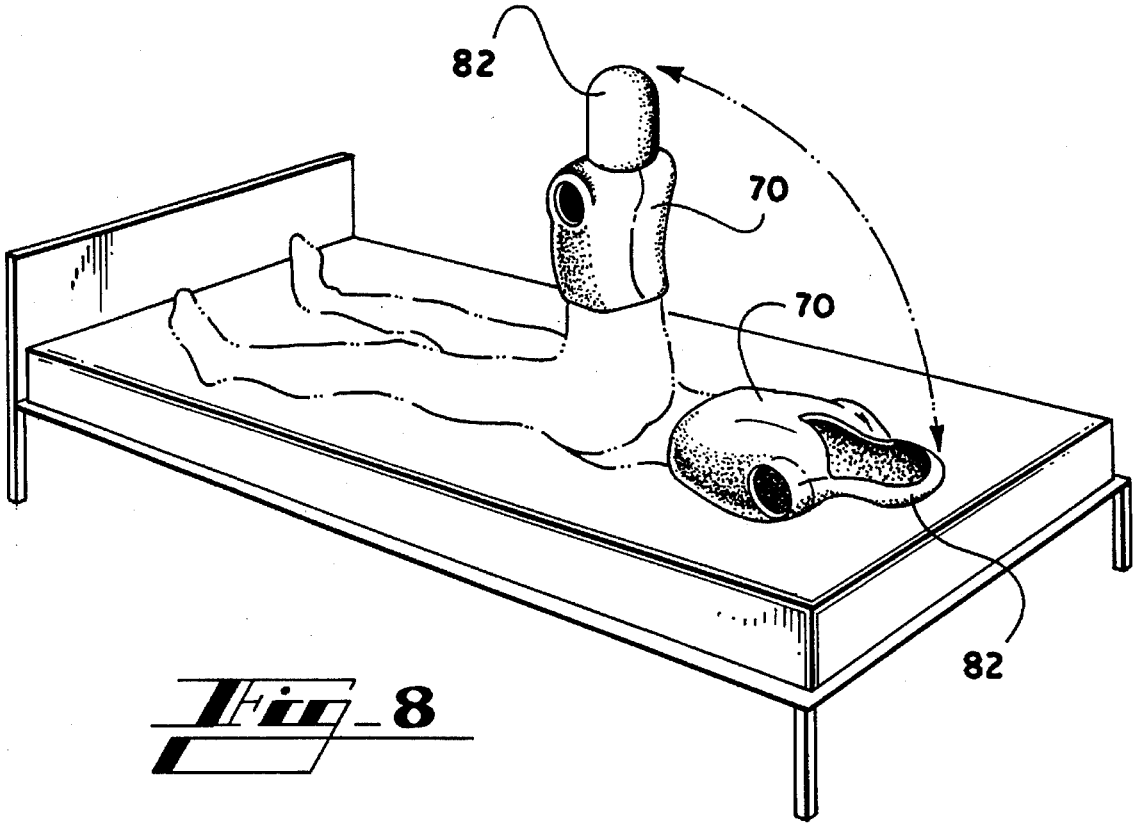
FIG. 8 is a perspective view of the vest of FIGS. 5 and 6 with an added sleeping cowl showing the positioning of a patient in the prone and sitting up positions.
Figure 7:
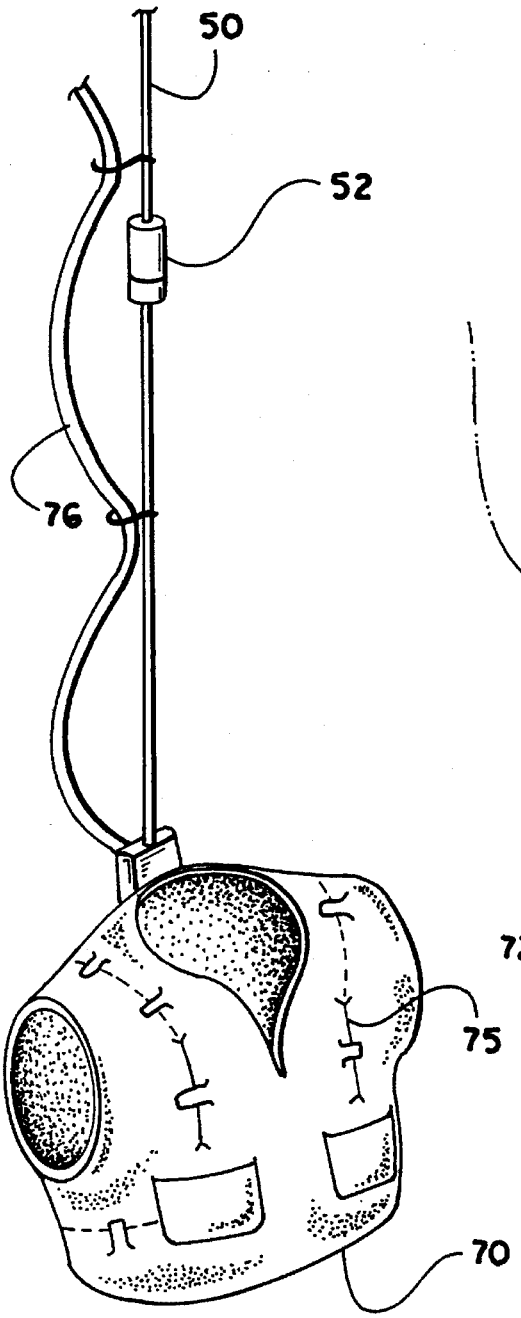
FIG. 7 is a perspective view of the vest of FIG. 5.
Figure 6:
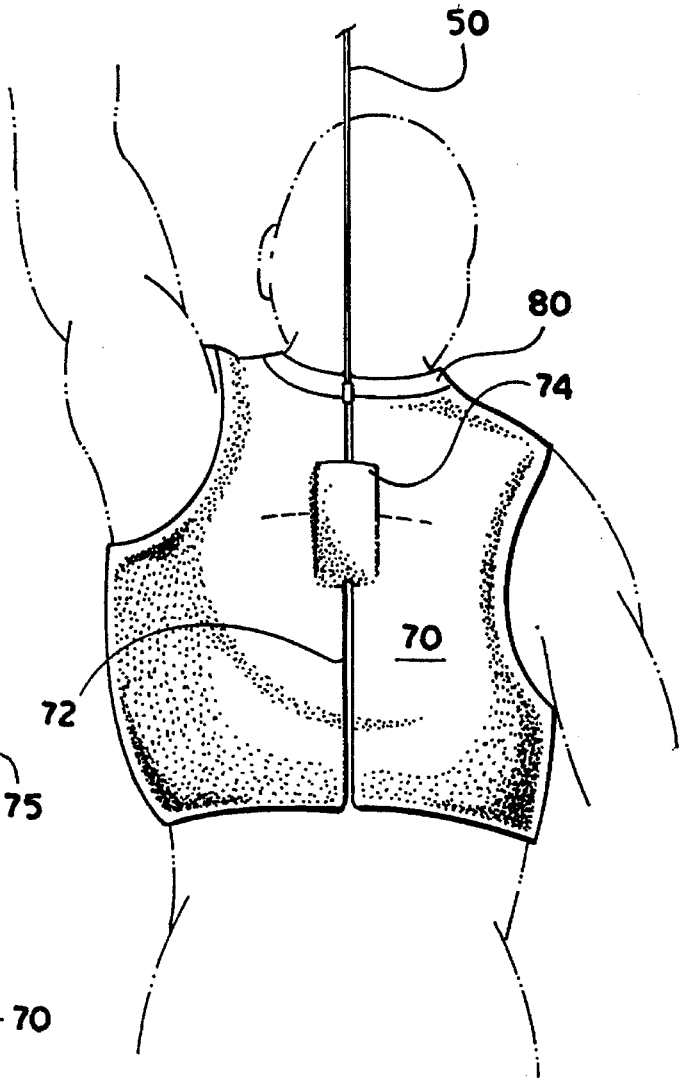
FIG. 6 is a rear view of a support vest for the present invention, which serves as a support garment for a patient.

FIGS. 6–8 disclose a preferred suspension garment or support garment of the present invention. FIG. 6 shows the rear view of a day vest 70 of the present invention mounted upon a patient. The vest includes an adjustable closure 72 along the spine of the patient and an attachment point 74 for the tether line 50. As shown in FIG. 7, an umbilical cord 76 may be provided which carries patient care or monitor lines to the patient. The tether line 50 includes a quick disconnect 52 so that the patient may be quickly disconnected from the ambulatory support system. As is shown in FIG. 7, the vest 70 includes indentations and holders 78 for providing patient care and monitor lines or attachments to the patient. An attachment 80 extends along the back of the day vest 70 for attaching a hood 82 to be worn while the patient is asleep. This hood 82 is shown in detail in FIG. 8. The hood 82 is preferably made of a combination of rigid, semi-rigid, and flexible materials and is designed so as to extend around the back of a head of a patient and upward to the top of the head. This rigid system keeps the tether line 50 away from the neck of a recumbent patient.

Within the support carrier 28 of the present invention is a retractable cord system. This retractable cord system is similar to that used for seat belts; that is, the system pulls in the tether line 50 when no downward pressure is applied to the end of the tether line and allows pulling of the tether line outward when a slow, even downward pressure is applied to the end of the tether line. However, if downward pressure is applied quickly, such as when a patient falls down or, in the case of a car seat belt, when an accident occurs, the retractable system locks in place and does not allow any of the tether line to be let out.

Preferably, the retractable system offers at least two forces which prevent the tether line 50 from being let out or causes tether line 50 to retract back into the support carrier 28. The first force supplied by the retraction system is applied only when a downward force is applied to the tether line 50. This type of situation occurs when the patient connected to the tether line 50 falls down. The first force varies in relation to the amount of downward force applied to the tether line 50, and the acceleration of the line downward. Thus, the first force acts in the same manner as the seat belt for an automobile. Although the first "force" is described as a force, the "force" acts more as a resistance. Thus, the first force acts as an opposition to let out of the tether line 50 and is responsive to a force which is applied downward on the tether line.

The second force keeps the tether line 50 taut such that when the patient is in the support garment or day vest 70 and attached to the tether line 50, the tether line remains extended from the day vest to the support carrier 28 in a substantially vertical orientation. This second force is inadequate to fully support the patient, and generally is used to keep slack from being formed in the rope. However, the second force may supply a minimal amount of support for the patient. This second force is less than the force needed to lift the patient and therefore may be used to give partial support to a weakened patient at all times. This force remains constant regardless of how much of the tether line 50 has been let out. Thus, as is shown in FIG. 8, the tether line 50 remains substantially vertical, and adjusts accordingly when a patient sits upward in his bed while wearing the sleeping hood 82. This second force helps to maintain the support courier 28 directly over the patient. This is important because the retraction system should apply a straight upward force on the tether line 50 so that the patient will be suspended from the tether line upon a fall, instead of swinging toward the location directly below the support carrier 28.

Preferably, the first force and the second force remain slightly less than the downward force applied by the patient so that the retraction system may work to decelerate a patient upon falling so that the patient is slowly lowered to the ground. The forces are regulated so a to ensure timely descent to the floor so as to prevent decreased cerebral blood flow in cases of fall due to circulatory failure (such as hinting or cardiac arrest). Regulating the forces in this manner also prevents inadvertent strangulation should the tether line 50 become entangled about the neck. The retraction system may include a third force which may be applied to lift the patient upon hitting the ground. This third force may be activated by the adjustment controls 56.

Figure 9:
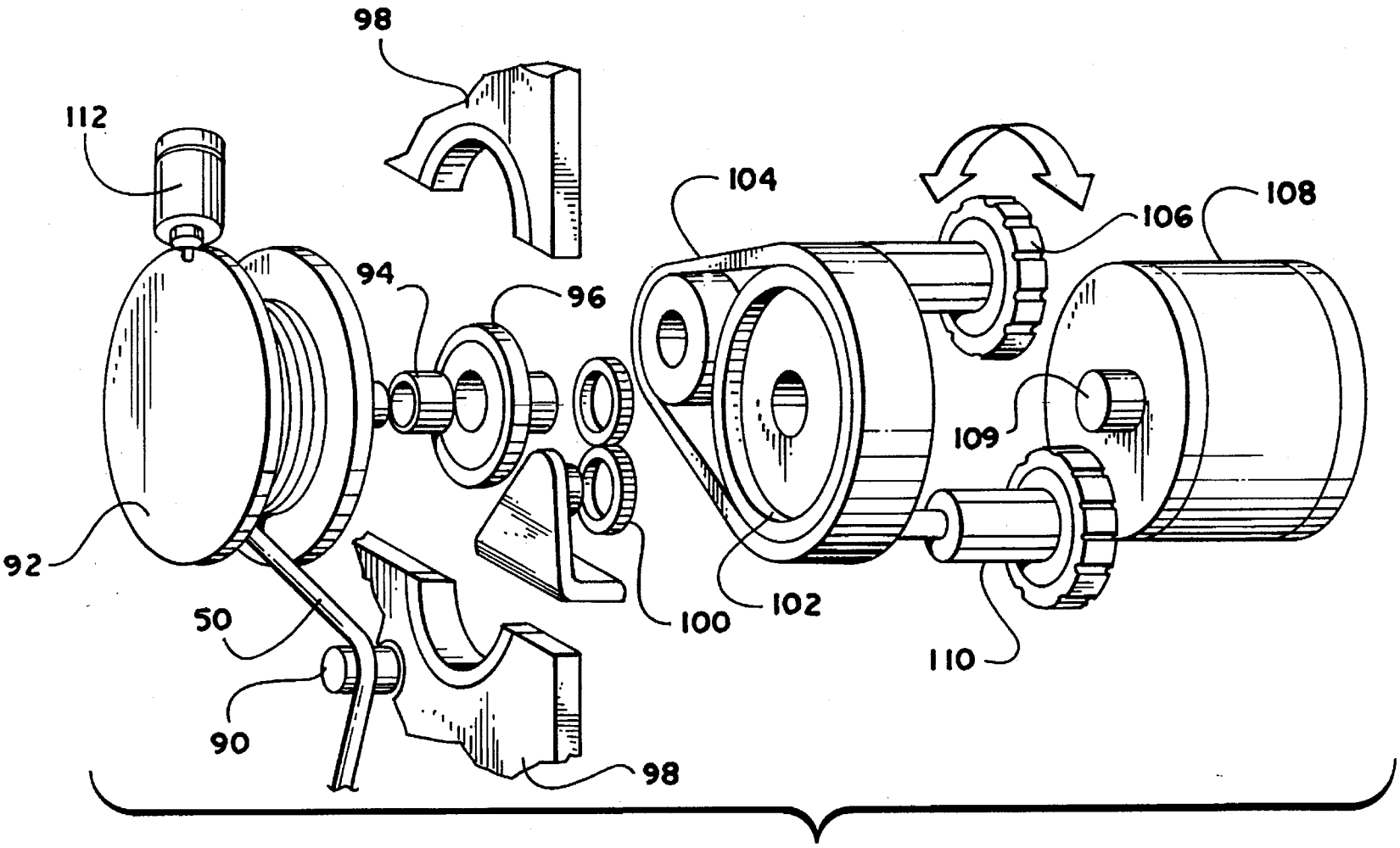
FIG. 9 is an exploded perspective view of the internal mechanism for at least one embodiment of the support carrier of FIG. 1.

A preferred method of providing the retraction system of the present invention is depicted in FIG. 9. As can be seen from the drawing, the tether line 50 extends over a non-twist mechanism 90 so that it may extend downward to the patient. The other end of the tether line is wound about a spring recoil and takeup reel 92. The spring recoil in this takeup reel 92 applies the second force through the tether line and makes sure the line is taut. The takeup reel 92 extends into a one-way bearing 94 which allows the takeup reel 92 to freely spin in the direction of recoil. The one-way bearing 94 is located within a bearing housing 96 which in turn is held in place in an enclosure 98. The end of this bearing housing 96 is associated by gears 100 to a flywheel 102. It is this gear reduction and the tension in the flywheel 102, created by a flywheel friction belt 104, which applies the first force to the tether line 50. The speed in which the bearing housing 96 and therefore the takeup reel 92 may rotate is determined by the speed of the flywheel rotating about its central axis. This speed is impeded by the friction belt 104 and is greatly reduced through the gears 100. Thus, when a downward force is applied to the tether line 50, the takeup wheel is turned in a counterclockwise rotation in FIG. 8 which allows the one-way bearing to turn in its proper direction and in turn turns the bearing housing 96. This turning is impeded by the resistance of the flywheel to rotating about its axis. The resistance of the flywheel to rotation may be increased by a belt tension adjustment knob 106, which is set to offset a patient's weight. On the support carrier 28, this knob may be located on the adjustment controls panel 56.

A motor 108 may be supplied which extends through the flywheel 102 and applies the third force described above. The rotation of the shaft 109 of this motor is independent of rotation of the flywheel. The flywheel lock pin 110 first locks the motion of the flywheel, allowing the motor to provide controlled lift through the takeup reel 92. The one-way bearing allows free spinning of the takeup wheel relative to the bearing housing 96, and therefore the flywheel and bearing housing are not spinning during motor operation. In this manner, the motor may supply any amount of lift to lift the patient above the ground or to apply a continuous force to the patient such that the tether line 50 may give a minimal amount of support to the patient. This minimal amount of support would be in addition to the tension provided by the takeup reel 92 and would be part of the second force described earlier. A patient position sensor 112 may be employed so that the support carrier 28 may be moved electronically or mechanically, responsive to movement of the patient.

Figure 10:
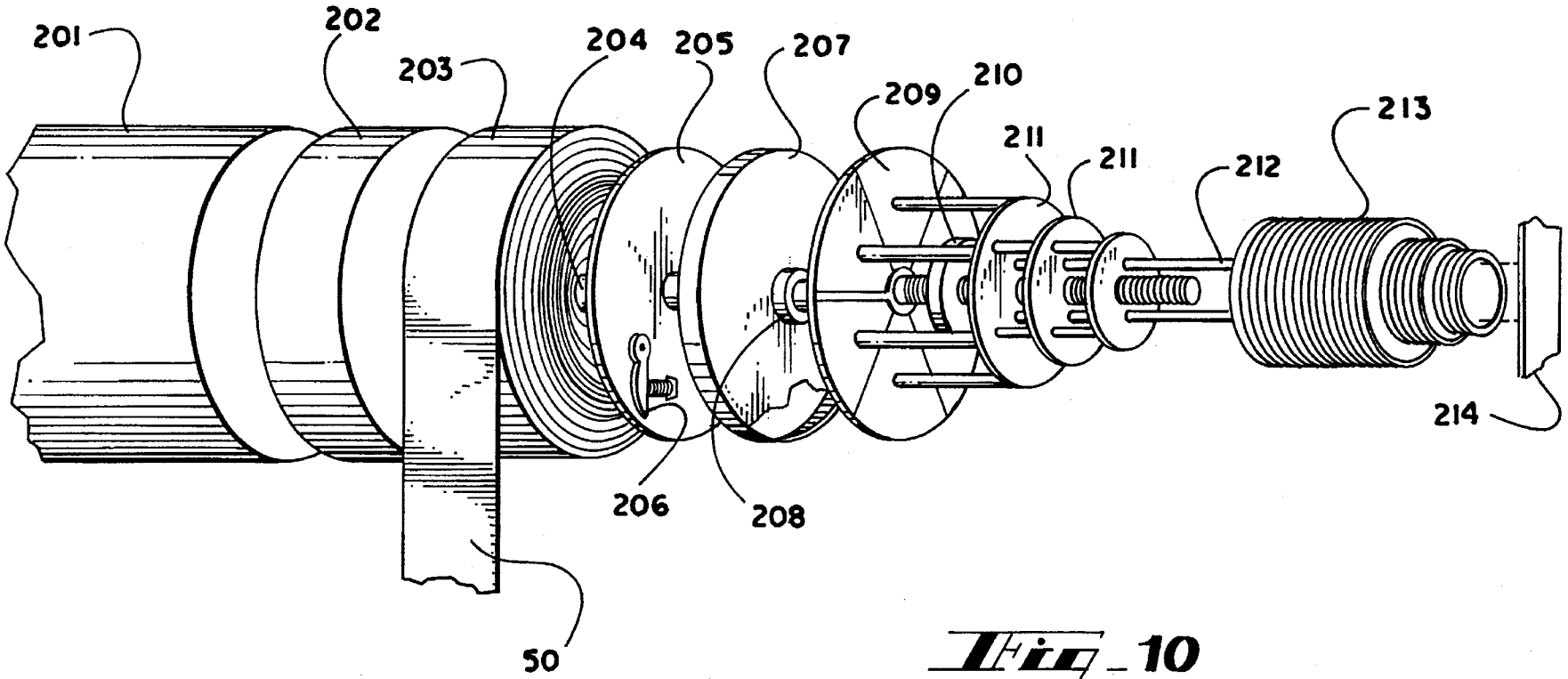
FIG. 10 is an exploded perspective view of an alterative embodiment of the internal mechanism of the support carrier of FIG. 1.

FIG. 10 discloses another manner of providing the retraction system for the support carrier 28 of the present invention. The embodiment shown includes a motor 201, a recoil mechanism 202, and a take-up reel 203 with tether line 50 extending therefrom, all being fixedly secured to a central axle 204. A rotor 205 is also fixed to this axle 204. A spring position lever 206 is attached to the rotor 205. A braking disc 207 encloses the rotor 205. A one-way bearing 208 attaches the braking disc to the axle 204. Segmental braking pads 209 are located next to the braking disc 207. The forward end of the central axle 204 includes a threaded portion. An actuator disc 210 is threaded on this portion of the axle 204. Concentric break supports 211 hold the brakes 209 in place and stabilizer bars 212 hold the brake supports 211 and actuator disc 210. A concentrically-positioned spring 213 provides pressure for the segmental brake pads 209. The end of the device shown in FIG. 9 is held in by an enclosure 214.

The device in FIG. 10 uses the recoil mechanism 202 and take-up reel 203 in a manner similar to the device shown in FIG. 9. These items help to maintain the tether line 50 in a taut position and help to keep the support carrier 28 directly above a patient. When excessive force is applied downward on the tether line 50, the rotor 205 spins and the increased centrifugal force causes the spring position lever 206 to be actuated and to engage the interior teeth on the braking disc 207. This spinning causes the actuator disc 210 to travel outward on the threaded portion of the axle as the patient belt is extended. As the actuator disc 210 is moving outward, the concentric brake 211 supports the sequential release of the pressure applied by the brake pads 209. In this manner, the speed in which the tether line 50 may be retracted out of the support carrier 28 is maintained at a minimum velocity.

It is to be understood that several other embodiments for supplying the retraction system of the present invention are possible. For example, a braking device disclosed in U.S. Pat. No. 5,147,265, would work to perform the needed results of the retraction system.

As can be understood from the above description, the present invention provides enhanced mobility and support for a patient. This system is intended for those patients who regularly are mobile. Some of these patients have no gait problems at all, but they are encumbered by fixed monitors and IV stands. These patients will benefit from the mobility afforded by the overhead design. IVs and monitors may follow the patient about the room with little or no effort provided by the patient.

The patient support system also benefits patients which are at high risk for falling, e.g., older adults or disoriented patients. Patients with good minds but weakened bodies may get up without prolonged wait for a nurse and without substantial risk. Many patients with diminished judgment or defective ambulation would no longer have to be tied to beds or require sitters.

Figure 11:
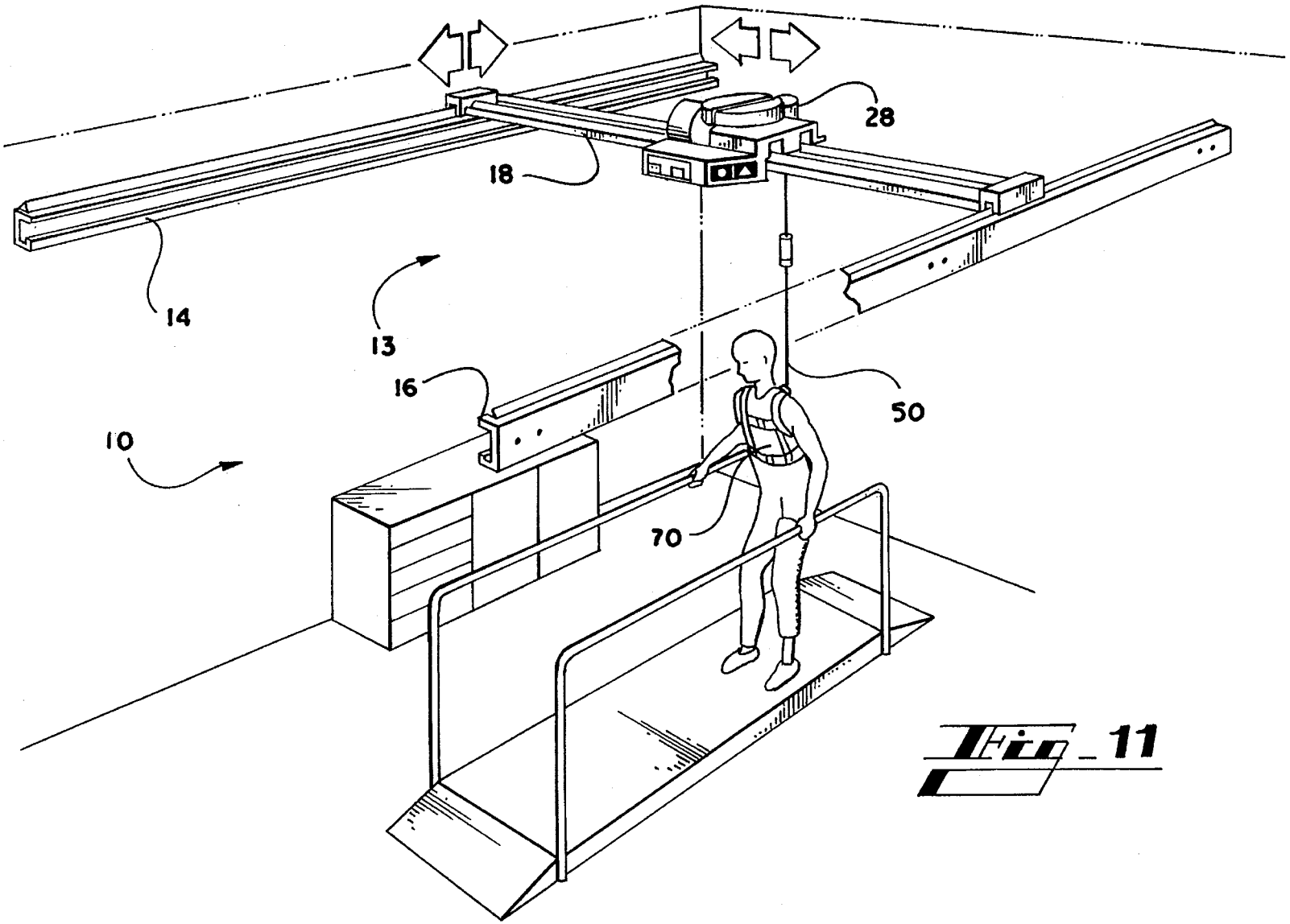
FIG. 11 is a perspective view of an alternative use for the ambulatory support system of FIG. 1 wherein the support system is used in a rehabilitation department.

The design allows the patient continued mobility so that the patient can move from a bed to a chair unassisted. Should a slip occur, the design protects the patient from a severe fall by the passive nature of the support system. Moreover, the system may be used to lend support to a patient in a rehabilitation department, as is shown in FIG. 11. In this manner, the patient may perform rehabilitation exercises without the need for support on both sides by hospital personnel.

While this system has been described in detail with a preferred embodiment in mind, modifications or alterations may be made without departing from the spirit and scope of the invention as defined in the following claims.

I claim:

1. An overhead support system for use in a hospital room, said support system comprising:

(a) a support garment for associating with said patient;

(b) a support carrier;

(c) a tether line extending from said support garment to the support carrier;

(d) a heavy glide rail defining ends thereon and arranged to span between opposite sides of the room, said support carrier being operative to travel back and forth on said heavy glide rail;

(e) channels operative for securement in said room for supporting said heavy glide rail such that said heavy glide rail can move therealong and such that said support carrier is capable of movement over a specified region of the room;

(f) a retraction system associated with said support carrier and operative to apply a first upward force to said tether line responsive to a force applied vertically downward by said patient, said first force varying in relation to said downward force applied by said patient and the acceleration of said tether line downward responsive to said downward force such that said first force remains slightly less than said downward force and prevents said acceleration of said tether line downward from reaching a predetermined speed, whereby said retraction system works to decelerate a patient upon falling so that said patient is slowly lowered to the ground; and (g) an accessory dolly slidably mounted for free travel along said heavy glide rail, said accessory dolly separated from said support carrier and configured so as to releasably receive a peripheral accessory whereby said peripheral accessory may be moved within an area underneath said overhead support system.

2. An overhead support system for use in a hospital room, said support system comprising:

(a) a support garment for associating with said patient;

(b) a support carrier;

(c) a tether line extending from said support garment to the support carrier;

(d) a heavy glide rail defining ends thereon and arranged to span between opposite sides of the room, said support carrier arranged to travel back and forth along said heavy glide rail;

(e) channels operative for securement in said room for supporting said heavy glide rail such that said heavy glide rail can move therealong and such that the support carrier is capable of movement over a specified region of the room;

(f) a retraction system associated with said support carrier and operative to apply a first upward force to said tether line responsive to a force applied vertically downward by said patient, said first force varying in relation to said downward force applied by said patient and the acceleration of said tether line downward responsive to said downward force such that said first force remains slightly less than said downward force and prevents said acceleration of said tether line downward from reaching a predetermined speed, whereby said retraction system works to decelerate a patient upon falling so that said patient is slowly lowered to the ground; and (g) a traveling bridge slidably mounted for moving back and forth along said channels, said traveling bridge including an accessory dolly mounted for travel along said traveling bridge, said accessory dolly configured so as to receive a peripheral accessory whereby said peripheral accessory may be moved within an area underneath said overhead support system.

3. The device of claim 1, wherein said retraction system is further operative to provide a second force upward on said tether line which keeps said tether line taut such that when a patient is in said support garment, said tether line remains extended from said support garment to said overhead system in a substantially vertical orientation, said second force being inadequate to fully support said patient.

4. The system of claim 2, further comprising a second accessory dolly slidably mounted for free travel along said heavy glide rail, said second accessory dolly separated from said support carrier and configured so as to receive a second peripheral accessory whereby said second peripheral accessory may be moved within an area underneath said overhead support system.

5. The device of claim 1, wherein said peripheral accessory comprises an IV pump.

6. The device of claim 1, wherein said peripheral accessory comprises a fold-up table.

7. The device of claim 1, wherein said peripheral accessory comprises a trapeze.

8. The device of claim 1, wherein said peripheral accessory comprises a fold-up chair.

9. The device of claim 1, wherein said peripheral accessory comprises an orthopedic traction set up.

10. The device of claim 1, wherein said peripheral accessory comprises patient monitoring equipment.

11. The device of claim 1, wherein said peripheral accessory comprises a suspended walker.

12. The device of claim 1, further comprising a traveling bridge for moving back and forth along said channels, said traveling bridge including an accessory dolly mounted for travel along said traveling bridge, said accessory dolly configured so as to receive a peripheral accessory whereby said peripheral accessory may be moved within an area underneath said overhead support system.

13. The device of claim 1, wherein said retraction system further comprises means providing a third force which may be applied upward on said tether line, said force being greater than said downward force applied by said patient, whereby said retraction system is operative to lift said patient.

14. The device of claim 2, wherein said peripheral accessory is releasably attached to the accessory dolly.

15. The system of claim 2, wherein said peripheral accessory comprises an IV pump.

16. The system of claim 2, wherein said peripheral accessory comprises a fold-up table.

17. The system of claim 2, wherein said peripheral accessory comprises a trapeze.

18. The system of claim 2, wherein said peripheral accessory comprises a fold-up chair.

19. The device of claim 2, wherein said peripheral accessory comprises an orthopedic traction set up.

20. The device of claim 2, wherein said peripheral accessory comprises patient monitoring equipment.

21. The device of claim 2, wherein said peripheral accessory comprises a suspended walker.

* * * * *